United States Patent [19]

Pocci

[11] Patent Number: 4,781,418

[45] Date of Patent: Nov. 1, 1988

[54] FLUID ACTUATED APPARATUS FOR MECHANICALLY SPLITTING ROCK-LIKE MATERIAL

[76] Inventor: Silvano Pocci, Eric Dr., Kinnelon, N.J. 07405

[21] Appl. No.: 56,462

[22] Filed: Jun. 1, 1987

[51] Int. Cl.[4] ..... E21C 37/02

[52] U.S. Cl. ..... 299/23

[58] Field of Search ..... 299/20–23; 166/177; 144/193 D; 254/104

[56] References Cited

U.S. PATENT DOCUMENTS

| | | | |
|---|---|---|---|
| 1,008,818 | 11/1911 | Harris | 299/23 |
| 1,034,860 | 8/1912 | Ballou | 299/23 |
| 3,791,698 | 2/1974 | Darda | 299/23 |
| 3,894,772 | 7/1975 | Darda | 299/22 |
| 4,026,602 | 5/1977 | Bieri | 299/22 |
| 4,266,827 | 5/1981 | Cheney | 299/20 |

*Primary Examiner*—Jerome W. Massie
*Assistant Examiner*—Matthew Smith
*Attorney, Agent, or Firm*—Alfred C. Hill

[57] ABSTRACT

Apparatus to break rock and concrete slabs in situ when inserted into predrilled holes in rock and concrete slabs comprises first and second members each having outer surfaces engaging walls of the predrilled holes; a third member having a driven end, a free end, a first surface parallel to the outer surfaces of the first and second members slidably engaging a flat bottom surface of a longitudinal groove in and coextensive with the first member and a second surface opposite the first surface having a first predetermined slope along a given length from a point adjacent the driven end to the free end, the third member reciprocating in the groove a predetermined number of times greater than one during each cycle of operation and with a predetermined stroke length; and an arrangement disposed between the second surface of the third member and an inner surface of the second member actuated by each inward stroke of the third member to apply a powerful breaking force directly to the second member resulting in lateral movement thereof, to apply a reaction force equal to the breaking force to the first member and to retain the second member in its achieved position due to the lateral movement at the end of each inward stroke of the third member during the cycle of operation while the third member is withdrawn prior to its next inward stroke.

20 Claims, 9 Drawing Sheets

FLUID ACTUATED APPARATUS FOR MECHANICALLY SPLITTING ROCK-LIKE MATERIAL

BACKGROUND OF THE INVENTION

The present invention relates to the breaking of rock and concrete slabs in situ into pieces small enough to remove by conventional earth moving equipment and more particularly to an improved apparatus to accomplish the same.

In the past, large rocks were split or cracked by the use of dynamite. This same technique can be employed with concrete slabs. When dynamite was used, it was necessary to drill bore holes in the rock into which a stick of dynamite was placed. An electric cap is attached to the stick of dynamite with the wires feeding therefrom connected in a circuit containing a switch and a source of electricity.

One of the drawbacks to using dynamite to split or crack large rocks and concrete slabs is the danger factor. If the blasting operation is to be performed in an area having building or homes in close proximity, it is necessary to cover the rock with a blasting mat to prevent propulsion of pieces of rock through the air in an uncontrolled manner. Special risks are created where the blasting operation takes place near gas lines. Also if dynamite is being used a special magazine is needed to store or carry the dynamite to the job site. The result of the danger necessitates the obtaining of special permits to perform the blasting operations and also necessitates costly liability insurance. Liability insurance premiums are a prime factor in the high cost of conventional explosive use.

A further drawback to the use of dynamite to split large rocks and concrete slabs in an area having building or homes in close proximity is due to the shock waves generated which travel along the rock ledge which can produce cracks in foundations of nearby homes, can crack well casings for on site artesian wells and can crack on site or home maintained septic systems. Thus, the home can be damaged and the artesian well can be polluted by cracks developed in the well casing and in septic systems on the home site.

Another drawback to the use of dynamite to split large rocks and concrete slabs is that it requires a trained expert to set the charge and explode it. In many cases this necessitates the hiring of a blasting contractor and delays may result from his having to fit your job into his schedule. Also special time consuming procedures are normally observed to insure safety and one of these is the requirement of removing personnel and/or equipment to a safer place while the blasting operation takes place. This in general results in production down time since the general work of the labor force is normally curtailed while the blasting process takes place.

A further drawback to the use of dynamite as opposed to a machine or tool that will perform the same result is the cost factor. The blasting caps required as well as the dynamite itself required to provide a useful force is expensive. Once the blasting operation occurs, these materials are lost and cannot be used again. If a tool or machine is utilized to perform the operation, it can normally be used again and again.

An additional drawback to the use of explosives for cracking or splitting of large rocks and concrete slabs is the relatively long time required to perform the preparation work. The charges are normally set in holes which have been drilled approximately four feet deep into the rock. The time required for drilling the first two feet of the hole takes about four minutes. To perform the next two feet of drilling requires more than twice that amount of time. One reason for this is the loss of hammering power due to the dampening effect on the longer shaft. An additional factor is the loss of sufficient air volume and pressure to exhaust chips from the bottom of the hole resulting in loss of drilling efficiency due to the padding effect caused by the chips that are not removed quickly enough. When long drilling time of these holes is multiplied times the number of holes that will be drilled in cracking a large rock, the total time becomes very substantial.

A final drawback to the use of dynamite for splitting large rocks is the environmental aspect. The use of dynamite results in the release of poisonous gases into the air. It also results in dust being stirred up into the atmosphere.

Machines or tools to break rock and concrete slabs are known in the prior art. The prior art uses a wedge having two tapered surfaces which is driven between two feathers or pressure cheeks which can be inserted in predrilled holes and the pressure cheeks or feathers are laterally moved by the longitudinal movement of the two surfaced tapered wedge.

Nine U.S. patents to H. DARDA of Germany have employed a hydraulic cylinder to move a wedge between two held feathers. These patents include U.S. Pat. Nos. 3,414,328; 3,439,954; 3,488,093; 3,526,434; 3,791,698; 3,883,178; 3,894,772; 3,957,309 and 3,995,906. In addition, patents of note are U.S. Pat. No. 2,093,452 issued to JOY as well as U.S. Pat. Nos. 3,550,191 and 3,572,840 issued to FLETCHER and U.S. Pat. No. 4,114,951 issued to LANGFIELD ET AL.

One disadvantage of the above prior art is that the steel thrust or wear plate employed in these apparatus often cracks or breaks during or as a result of the thrust and splitting action movement of the two surfaced tapered wedge. These wear or thrust plates are retained by grooves and/or screws. Under this thrusting action and when and where dirt, rock or other material or factors reduce the ability of the wedge to slide along the face of the feathers an increase of pressure and a cracking or breaking of these wear plates results. Repeated actuation of the wedge to produce this splitting action often causes cracked or broken wear or thrust plates to cut or mutilate the housing or retainer, usually made of aluminum, to the extent that it is not satisfactorily useable.

All of the prior art known uses hydraulic or air pressure (fluid pressure) to power a mechanical device. Virtually all the prior art uses the same principle, namely, the transfer of longitudinal power through the mechanical advantage of a tapered wedge having two tapered surfaces to lateral power exterted upon the sides of predrilled holes in rock or concrete slabs.

The prior art apparatus is able to generate forces of less than one million pounds per square inch which is far below the forces needed to break granite and trap rock. As a result of this, the state of the art apparatus necessarily limits its use to the breaking of concrete slabs, softer rock and minerals.

A majority of the prior art apparatus uses wedges having a mechanical advantage of approximately 10 to 1. This prior art apparatus must do so for a number of reasons; (1) holes drilled in rock vary in the size of diameter of the drilled holes into which the feathers must fit, (2) when the holes are drilled they are not drilled straight and the feathers cannot be made too long or breakage results.

Devices of the prior art can only increase power in one of three basic ways (1) increase power of the hydraulic ram by (a) increasing the pressure over 7,100 psi which is really not feasible, (b) increase the size of the hydraulic cylinder which results in a subsequent increase in bulk and unmanageability; (2) change the mechanical advantage over 10 to 1 by making the wedge thinner relative to length which increases the stroke length, or making the wedge longer which also increases the stroke length. With both of these remedies there is required a corresponding increase in the predrilled hole length. Most of the problems in the prior art occur because of the requirement of deep holes. To double the power to 20 to 1 mechanical advantage requires doubly the length of the hole that is predrilled in the rock.

SUMMARY OF THE INVENTION

A first object of the present invention is to provide an apparatus for splitting large rocks and concrete slabs that will not throw debris or send massive uncontrolled shock waves throughout the surrounding area.

A second object of the present invention is to provide a device for splitting large rocks and concrete slabs that will eliminate use of dynamite with its attendant dangers.

A third object of the present invention is to provide an apparatus for splitting large rocks and concrete slabs that will not necessitate the movement of personnel and/or equipment to a safe place while the apparatus is in operation.

A fourth object of the present invention is to provide an apparatus for splitting large rocks and concrete slabs that would not disturb the surrounding area or loosen the walls of a ditch or tunnel in close proximity thereto thus exposing personnel to unnecessary cave-in hazards.

A fifth object of the present invention is to provide an apparatus for splitting large rocks and concrete slabs that does not require the person operating the apparatus to have extensive special knowledge such as is required of an explosive expert.

A sixth object of the present invention is to provide an apparatus for splitting large rocks and concrete slabs that does not release any poisonous gas or throw any dust into the air.

A seventh object of the present invention is to provide an apparatus for splitting large rocks and concrete slabs that will eliminate the need for large liability insurance premiums such as are necessitated by the use of dynamite.

An eighth object of the present invention is to provide apparatus for splitting large rocks and concrete slabs that can be used over and over again thereby cutting down the cost of such an operation.

A feature of the present invention is the provision of apparatus to break rock and concrete slabs in situ when inserted into predrilled holes in rock and concrete slabs comprising first and second members each having outer surfaces engaging walls of the predrilled holes; a third member having a driven end, a free end, a first surface parallel to the outer surface of the first and second members slidably engaging a bottom surface of a longitudinal groove in the first member and a second surface opposite the first surface having a first predetermined slope along a given length from a point adjacent to the driven end to the free end, the third member reciprocating in the groove a predetermined number of times greater than one during each cycle of operation and with a predetermined stroke length; and means disposed between the second surface of the third member and an inner surface of the second member actuated by each inward stroke of the third member to apply a powerful breaking force directly to the second member resulting in lateral movement thereof, to apply a reaction force equal to the breaking force to the first member and to retain the second member in its achieved position due to the lateral movement thereof at the end of each inward stroke of the third member during the cycle of operation while the third member is withdrawn prior to its next inward stroke.

Another feature of the present invention is the provision of a dramatic increase in the power generated by the use of wedging action which is achieved by the thickness of the third member decreasing by a predetermined amount at the free end thereof to provide the first predetermined slope along the given length.

Still another feature of the present invention is the provision of a housing to protect the first, second and third members and the means to apply and retain from dust, dirt and alike; and a lubricant disposed in the housing to lubricate engaging surfaces of the first, second and third members and the members of the means to apply and retain.

A further feature of the present invention is the provision of reset means secured to the third member adjacent the drive end to reset the means to apply and retain to the starting position at the end of each of the cycles of operation.

Still a further feature of the present invention is the provision of locking means associated with the retaining means and the means to apply and retain to hold the means to apply and retain in a starting position and to reset the retaining means, the locking means being operated to release the means to apply and retain to start each of the cycles of operation.

An additional feature of the present invention is the provision of the means to apply and retain including a fourth member having a first surface parallel to the outer surface of the first and second members and a second surface opposite the first surface slidable engaging the second surface of the third member, the second surface of the fourth member having a slope equal to but opposite the first predetermined slope; a fifth member having a first surface parallel to the outer surface of the first and second members slidably engaging the first surface of the fourth member and a second surface opposite the first surface having a second predetermined slope engaging an inner surface of second member, the inner surface of second member having a slope equal to but opposite the second predetermined slope, the fifth member responding to each inward stroke of the third member through the fourth member to apply the powerful breaking force to the second member and the reaction force to the first member, the second member moving laterally outward a greater amount on each inward stroke of the third member, and a sixth member straddling the third and fourth members and enclosing the fifth member, the sixth member having a first surface adjacent the groove of the first member parallel to the outer surface of the first and second members and a second surface opposite the first surface having a slope equal to the second predetermined slope slidably engaging the inner surface of the second member to maintain an outward position achieved by the second member after each inward stroke of the third member while the third member is withdrawn prior to its next inward stroke.

Still a further feature of the present invention is the provision of low profile teeth on the second surfaces of the fifth and sixth members slidably engaging low profiled teeth present in the inner surface of the second member, the low profile teeth in the second surface of the sixth member and the inner surface of the second member cooperating to maintain the outward position achieved by the second member after each inward stroke of the third member.

BRIEF DESCRIPTION OF THE DRAWING

Above-mentioned and other features and objects of the present invention will become more apparent by reference to the following description taken in conjunction with the accompanying drawing, in which.

DESCRIPTION OF THE PREFERRED EMBODIMENT

The rock breaking and concrete slab breaking mechanism of the present invention utilizes a mechanism capable of generating forces upward of 25,000,000 psi (pounds per square inch) by using conventional hydraulic or pneumatic cylinders (fluid cylinders) as the power source. The apparatus of the present invention functions by the insertion of the apparatus into a predrilled hole in the rock or concrete slab.

As mentioned hereinabove the prior art apparatus is able to generate forces of less than 1,000,000 psi which is far below the forces needed to break granite and trap rock. The present invention makes possible a dramatic increase in the power generated by the use of wedging action of one surface of a power wedge having a relatively low slope where the thickness of the power wedge decreases by an amount equal to 0.030 inches to 0.050 inches at the free end thereof along a length of the power wedge equal to 6" to 8". This low slope of the single surface of the power wedge increases the mechanical advantage far beyond that which has been possible to date.

Figure 1:
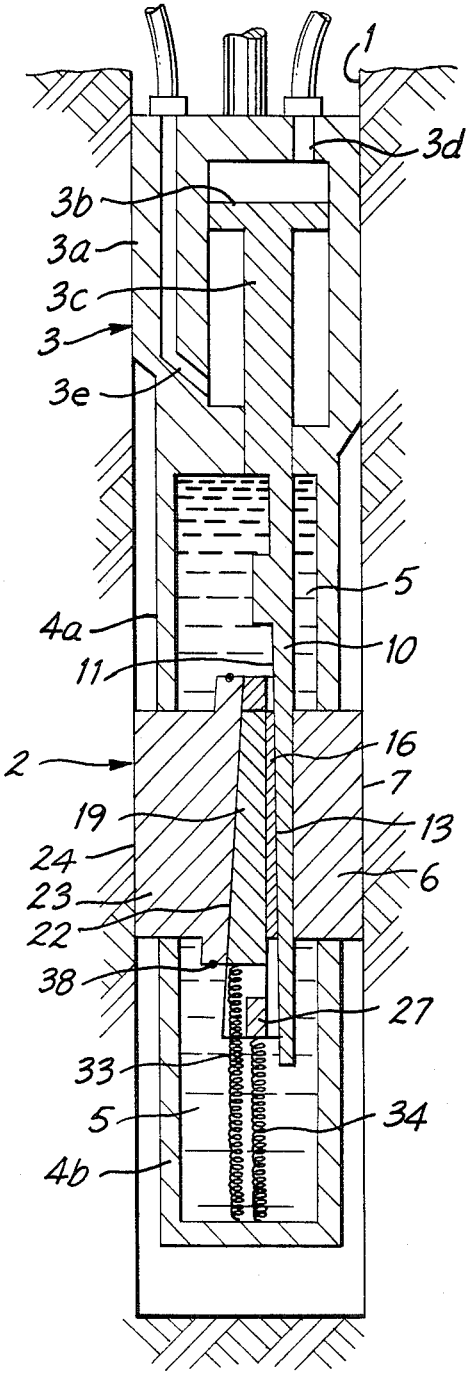
FIG. 1 is a cross-sectional view illustrating the components of the apparatus in accordance with the principles of the present invention in position within a predrilled hole in rock and/or a concrete slab.
Figure 3:
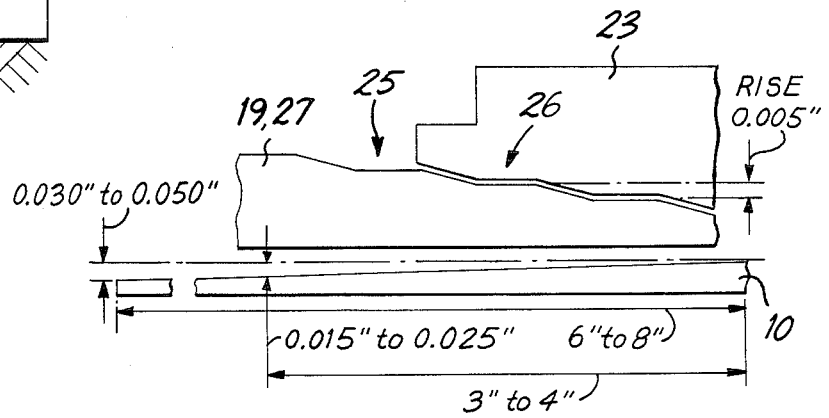
FIG. 3 is a side view of various members of the apparatus in accordance with the principles of the present invention showing in an enlarged view the low profile teeth in adjacent surfaces of members thereof.
Figure 2:
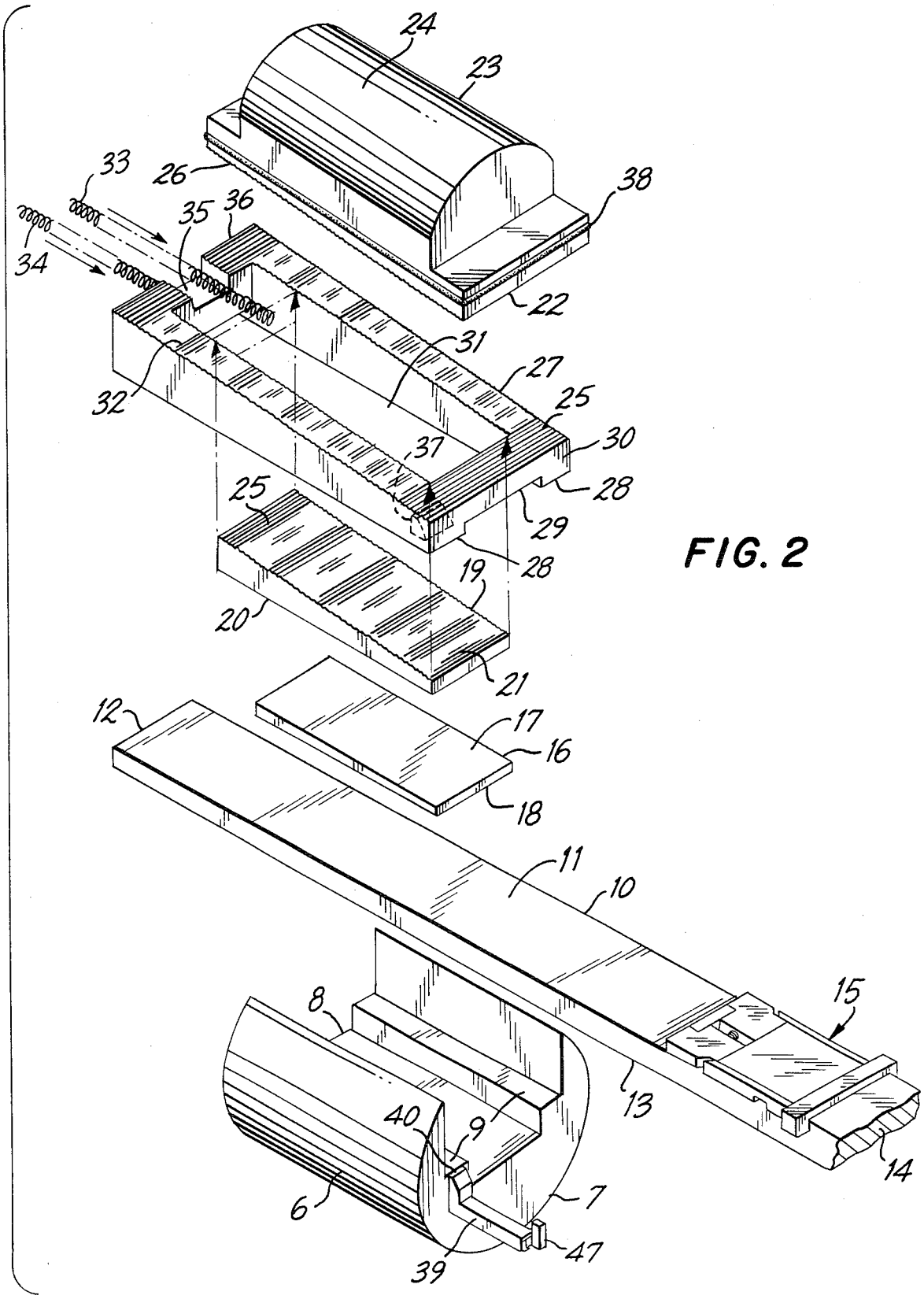
FIG. 2 is a perspective exploded view of the apparatus in accordance with the principles of the present invention.

Referring to FIGS. 1 and 2, the apparatus of the present invention is illustrated in a cross-sectional view in FIG. 1 and in a perspective exploded view in FIG. 2 is disposed in a predrilled hole 1 in rock or a concrete slab. The apparatus of the instant invention includes members all made of hardened steel. The rock buster 2 is operated by a fluid operated reciprocating apparatus 3 with the rock buster 2 under the influence of apparatus 3 expanding to crack the rock surrounding the predrilled hole. An upper housing **4*a* and a lower housing 4*b* protects the rock buster 2 from dirt, dust and the like and holds a lubricant 5, such as an oil, that lubricates the members of the rock buster 2**.

As shown in FIG. 1 fluid (liquid or gas) operated apparatus 3 includes a cylinder **3*a* which is a continuation of upper housing 4*a* and a piston 3*b* which is connected to power wedge 10 by means of ram 3*c*. An inlet port 3*d* to cylinder 3*a* controls the power stroke of ram 3*c* and, hence, power wedge 10. An inlet port 3*e* to cylinder 3*a* controls the return or withdrawl stroke of ram 3*c* and, hence, power wedge 10**.

Because the apparatus of the present invention is a sealed unit the power or inward stroke of power wedge 10 causes a decrease in the volume of the lower oil reservoir in lower housing **4*b* thereby driving oil through lubricating slots in the wedges and other members of rock buster 2 into the upper oil reservoir in upper housing 4*a***.

As can be seen in FIG. 1 the apparatus of the present invention includes a fluid operated apparatus 3 that is small enough to enter and operate within the full depth of the predrilled hole. This is not the case with respect to most of the known prior art devices, since most of the prior art devices require a fluid operated, device, such as a jack hammer, which has a diameter greater than that of the predrilled hole.

In operation, the apparatus or unit of the present invention can be inserted as a complete unit into predrilled hole 1 in stages or steps of progressive steps until the bottom of the predrilled hole 1 is reached. At each step or stage of insertion the apparatus is activated to run through its cycle of operation to thereby break or crack the rock or concrete slab surrounding the predrilled hole 1 at each progressive step or stage of depth in the predrilled hole 1. This operation makes it easier and simpler to break or split rock to a greater depth in a single predrilled hole than can be accomplished by known prior art apparatus.

At this point the mechanical advantage of the apparatus of the present invention will be demonstrated by an example. Assume rock buster 2 has a diameter of 2½" and a cylinder **3*a* has a diameter of 2" with a working pressure of 7,100 psi. The diameter of piston 3*b* would be 2" which results in a piston head area of 3.1416". The total thrust of ram 3*c* would be 3.1416×7,100 or 22,305 lbs (pounds). With a 5.5" stroke of ram 3*c* and with a rise of 0.025" on the power wedge 10, the mechanical advantage is 220:1 resulting in 22,305×220 or 4,907,100 lbs of force exerted on the rock or concrete slab surrounding predrilled hole 1**. This is a seven (7) times increase in cracking force over that achieved by prior art apparatus using a considerably smaller unit.

As can be seen best in FIG. 2, rock buster 2 includes a U-shaped anvil 6. Anvil 6 has its outer surface 7 in contact with the rock wall of predrilled hole 1. A longitudinal groove 8 and ledges 9 are parallel to outer surface 7. The power wedge 10 has a taper on one surface only thereof, namely, surface 11. For instance, power wedge 10 is twice as long as anvil 6 and the other wedges described hereinbelow. Surface 11 has a slope provided by decreasing the thickness of power wedge gradually over a given length, for instance 6" to 8", until the thickness of its free end is 0.030" to 0.050". It should be noted that the active slope is half of the above amount name 0.015" to 0.025" over a given length of 3" to 4". Each stroke of power wedge 10 expands rock buster 2 by an amount equal to 0.015" to 0.025". The power generated can be changed by changing the length of power wedge 10 and the slope of surface 11 of power wedge 10. Surface 13 of power wedge 10 is parallel to surface 7 of anvil 6. Power wedge 10 is thrust by the apparatus 3 inward and outward in a reciprocating manner a specific non-varying distance, or, in other words, has a predetermined stroke length. Mounted on power wedge 10 adjacent the driven end is a reset mechanism 15 which at the proper time in the operative cycle acts in concert with other mechanisms to rese the rock buster 2. Power wedge 10 has formed therein grooves, not shown, to enable the lubrication thereof by the lubricant 5. Power wedge 10 is the member which generates the powerful breaking force applied to the rock or concrete slab in the wall of the predrilled hole 1.

Separator plate 16 has a first surface 17 parallel to the outer surface 7 of anvil 6 and a second surface 18 having the same but opposite slope as surface 11 of power wedge 10. Separator plate 16 separates power wedge 10 from pressure wedge 19 and is in a sliding engagement with surface 11 of power wedge 10. As power wedge 10 increases in thickness it transmits this power to pressure wedge 19.

Pressure wedge 19 has a first surface 20 parallel to outer surface 7 of anvil 6 which slidably engages surface 17 of separator plate 16 and a second surface 21 having a second predetermined slope engaging an inner surface 22 of cracker bar 23. The surface 21 of pressure wedge 19 has a predetermined slope which may be equal to or different than the slope of surface 11 of power wedge 10. Surface 22 of cracker bar 23 has the same but opposite slope as surface 21 of pressure wedge 19. The outer surface 24 of cracker bar 23 is parallel to outer surface 7 of anvil 6 and engages the wall of predrilled hole 1. Pressure wedge 19 transmits the power of power wedge 10 through separator plate 16 directly to cracker bar 23 and by a reaction force to anvil 6.

Holding wedge 27 surrounds pressure wedge 19 and is movable relative therto both longitudinally and laterally. Holding wedge 27 has a pair of surfaces 28 that sidably engage ledges 9 and an opening 29 therebetween that enables reset mechanism 15 to enter holding wedge during each stroke of power wedge 10, except the last, with transverse end surface 30 cooperating with reset mechanism 15 to reset the components of rock buster 2 on the last inward stroke of a cycle of operation of power wedge 10 as will be described thereinafter with reference to FIGS. 8–11D. Pressure wedge 19 is contained in cavity 31 of holding wedge 27. Surface 32 of holding wedge 27 has the same slope as surface 21 of pressure wedge 19. Spring 33 extends through a groove 35 in wall 36 of wedge 27 to control the longitudinal movement of pressure wedge 19 and spring 34 controls the longitudinal movement of holding wedge 27. Surface 32 of holding wedge 27, surface 21 of pressure wedge 19 and surface 22 of cracker bar 23 have low profile teeth 25 and 26. Teeth 25 on surface 32 of holding wedge 27 and teeth 26 on surface 22 of cracker bar 23 mesh when a void exists between pressure wedge 19 and cracker bar 23 which occurs at the end of each power stroke when power wedge 10 is being withdrawn. The teeth 25 and 26 have a configuration designed to lock holding wedge 27 and cracker bar 23 together and thereby maintain cracker bar 23 and anvil 6 in the lateral or expanded position achieved during the just completed power stroke of power wedge 10.

At the end of an operating cycle, locking mechanism 39 mounted on anvil 6 has an end 40 which engages a notch 37 in surface 28 of holding wedge 27 to lock holding wedge 27 and, thus, the other members of rock buster 2 in the start position.

Cracker bar 23 has a small groove 38 containing therein an "O" ring to seal cracker bar 23 to the legs of U-shaped anvil 6 to prevent the lubricating oil from escaping from the upper and lower reservoirs of housings 4*a* and 4*b*.

Figure 4A:
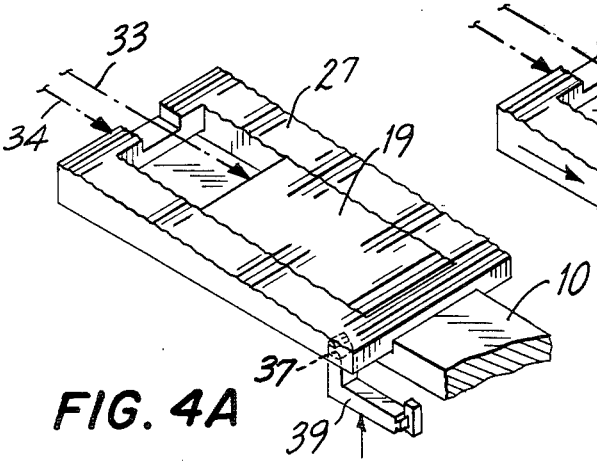
FIGS. 4A–4F illustrate the operation of the apparatus in accordance with the principles of the present invention.
Figure 4B:
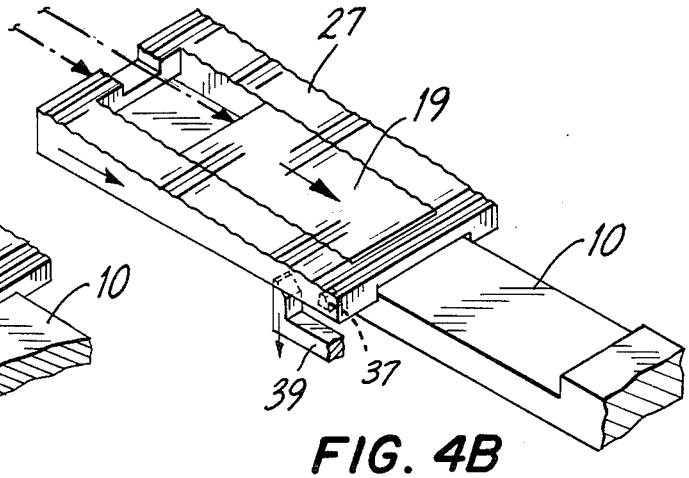
Figure 4C:
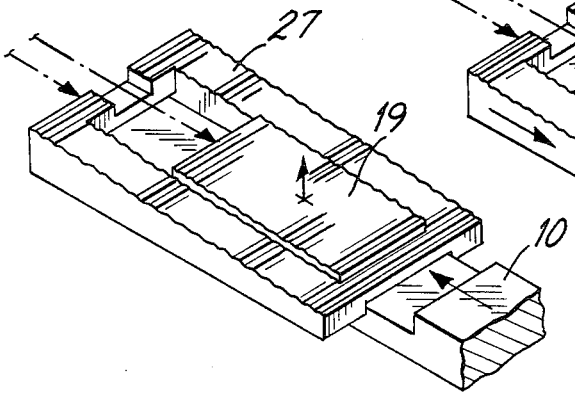
Figure 4D:
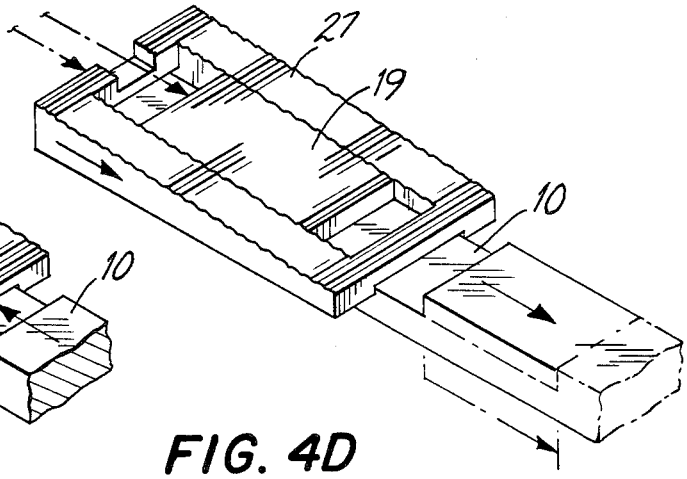
Figure 4E:
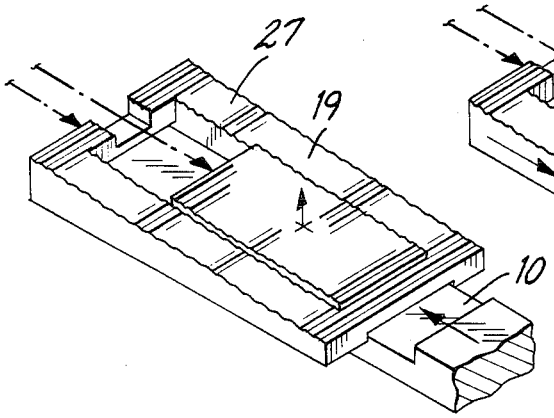
Figure 4F:
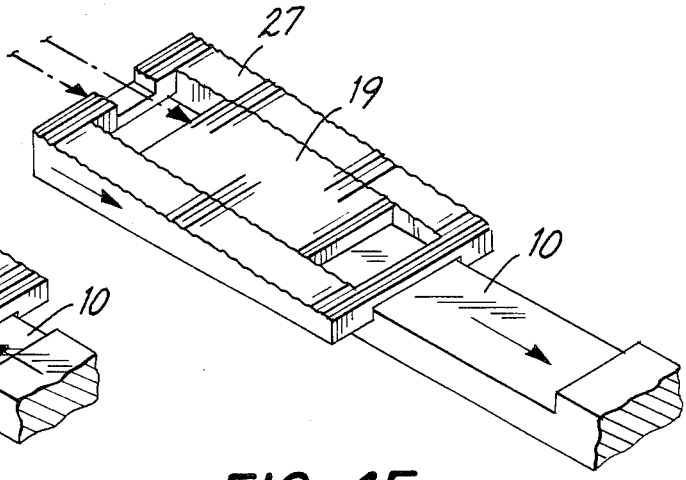

Referring to FIGS. 4A–4F, the operation of the apparatus of the present invention will now be described. The apparatus as seen in FIG. 1 is inserted into predrilled hole 1. A void exists between the walls of hole 1 and the fully retracted rock buster 2. The locked position of power wedge 10, pressure wedge 19 and holding wedge 27 is shown in FIG. 4A. The unlocked or start position of power wedge 10, pressure wedge 19 and holding wedge 28 is shown in FIG. 4B At this point wedges 19 and 27 move so that rock buster 2 expands itself to bring the anvil 3 and cracker bar 23 into engagement with the wall of hole 1, thereby eliminating the above-mentioned void. The power wedge 10 is then operated to transmit power generated through the mechanical advantage of the slope of surface 11 of power wedge 10 through separator plate 16 and pressure wedge 19. As noted hereinabove pressure wedge 19 acts directly upon cracker bar 23 and through a reaction force on anvil 6. Expansion of the rock buster 2 by the action shown in FIG. 4C to start cracking the rock had the effect of creating a void equal to the amount of "rise" or slope provided on surface 11 of power wedge 10. This action has made surface 22 of cracker bar 23 and surfaces 9 of anvil 6 move further apart. This void is now removed by the action of spring 34 which forces holding wedge 27 into the void, bringing it once again in solid contact with surfaces 9 of anvil 6 and surface 22 of cracker bar 23. The "rise" in the teeth of surface 22 of cracker bar 23 and surface 32 of holding wedge 27 is such that with each stroke of the power wedge 10, holding wedge 27 is able to move forward into the newly created void. As the power wedge 10 is withdrawn (dotted lines in FIG. 4D) and holding wedge 27 moves to fill the void, the expanded state of pressure wedge 19 is effectively removed. Holding wedge 27 through the low profile teeth 25 and 26 is holding rock buster unit 2 in its expanded state, that is, cracker bar 23 is held at the lateral position it has achieved by the longitudinal motion of the power wedge 10. This action continues as each power stroke expands rock buster 2 to its designed limits as noted in FIGS. 4E and 4F.

Figure 5A:
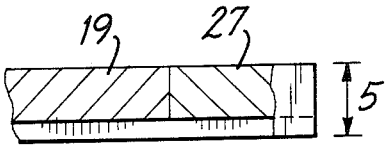
FIGS. 5A–5I is another illustration of the operation of apparatus in accordance with the principles of the present invention.
Figure 5B:
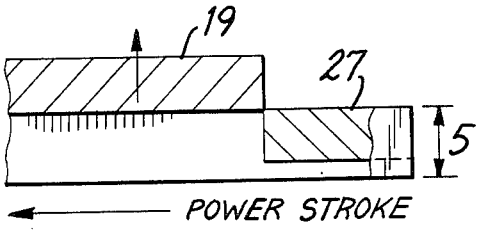
Figure 5C:
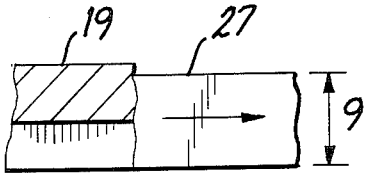
Figure 5D:
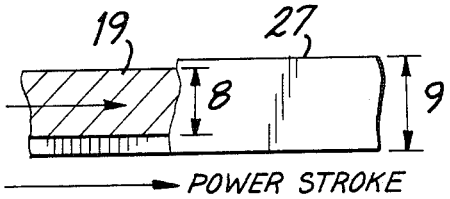
Figure 5E:
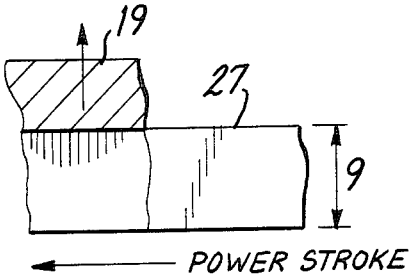
Figure 5F:
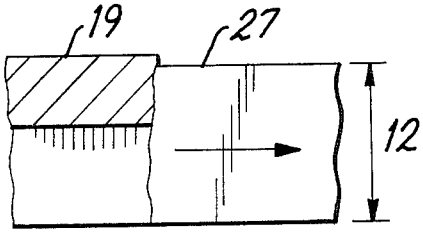
Figure 5G:
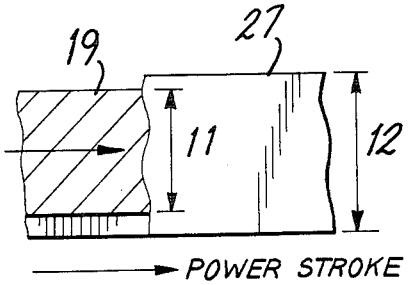
Figure 5H:
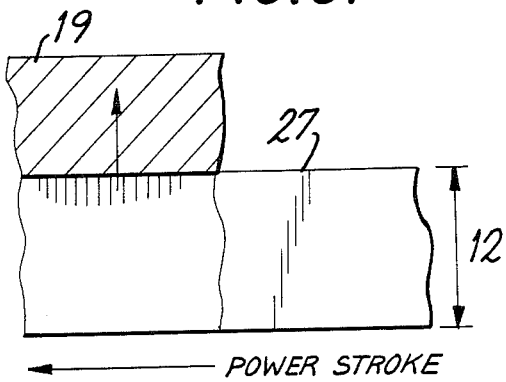
Figure 5I:
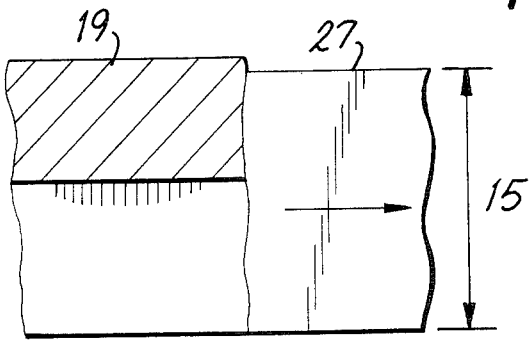

Referring to FIGS. 5A–5I, there is illustrated therein the operation that takes place on each stroke of power wedge 10 relative to the movement of pressure wedge 19 and holding wedge 27 to facilitate the expansion action. FIG. 5A shows the start position while FIG. 5B shows the lateral movement of pressure wedge 19 during a power stroke. Pressure wedge 19 holds its position as holding wedge 27 fills the void as shown in FIG. 5C by the increase in the thickness of holding wedge 27 from 5 to 9 units of thickness. Power wedge 10 withdraws as shown in FIG. 5D with holding wedge 27 holding its position as pressure wedge 19 fills any voids present. Note the thickness of pressure wedge 19 as 8 units. FIG. 5E illustrates the next power stoke with pressure wedge 19 moving laterally such that unit 2 again expands to break the rock. In FIG. 5F pressure wedge 19 holds its position as holding wedge 27 fills the void. Note change of thickness from 9 units to 12 units. FIG. 5G illustrates the position of pressure wedge 19 and holding wedge 27 upon withdrawl of power wedge 10. As illustrated holding wedge 27 holds its position as pressure wedge 19 fills any voids. Note the thickness of pressure wedge 19 at 11 units. FIG. 5H shows the next power stroke and a further lateral movement of pressure wedge 19 with holding wedge 27 holding its position achieved in FIG. 5G. In FIG. 5I pressure wedge 19 holds its position as holding wedge 27 fills any voids. Note the change of the thickness of holding wedge 27 from 12 units to 15 units. This action continues until the end of the operating cycle.

Figure 6A:
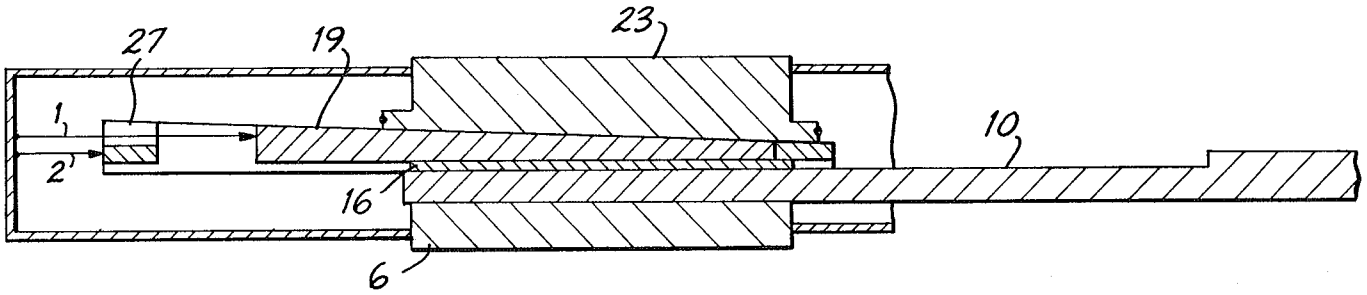
FIGS. 6A–6G are cross-sectional views useful in further explaining the operation of the components of the apparatus in accordance with the principles of the present invention.
Figure 6B:
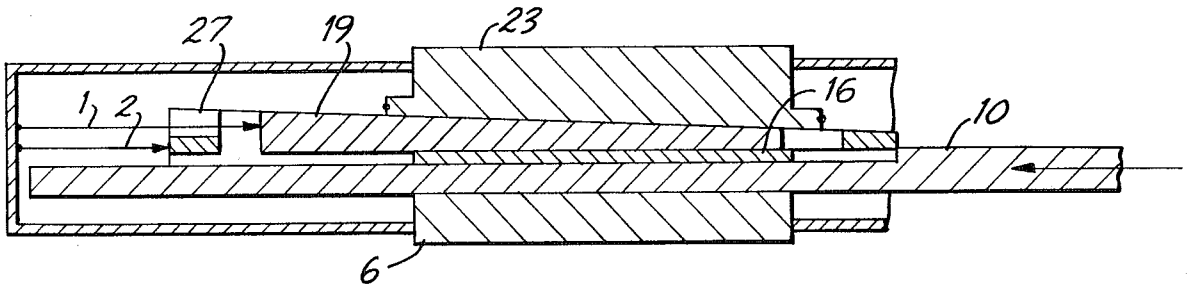
Figure 6C:
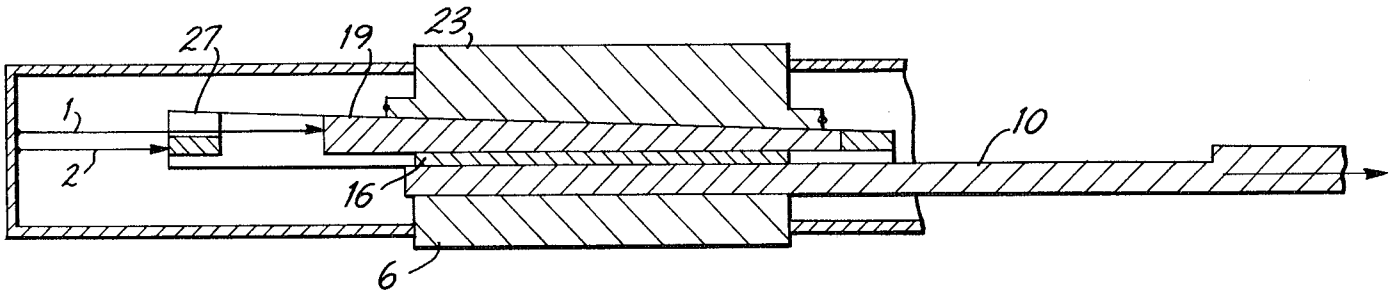
Figures 6D, 6E, 6F, 6G:
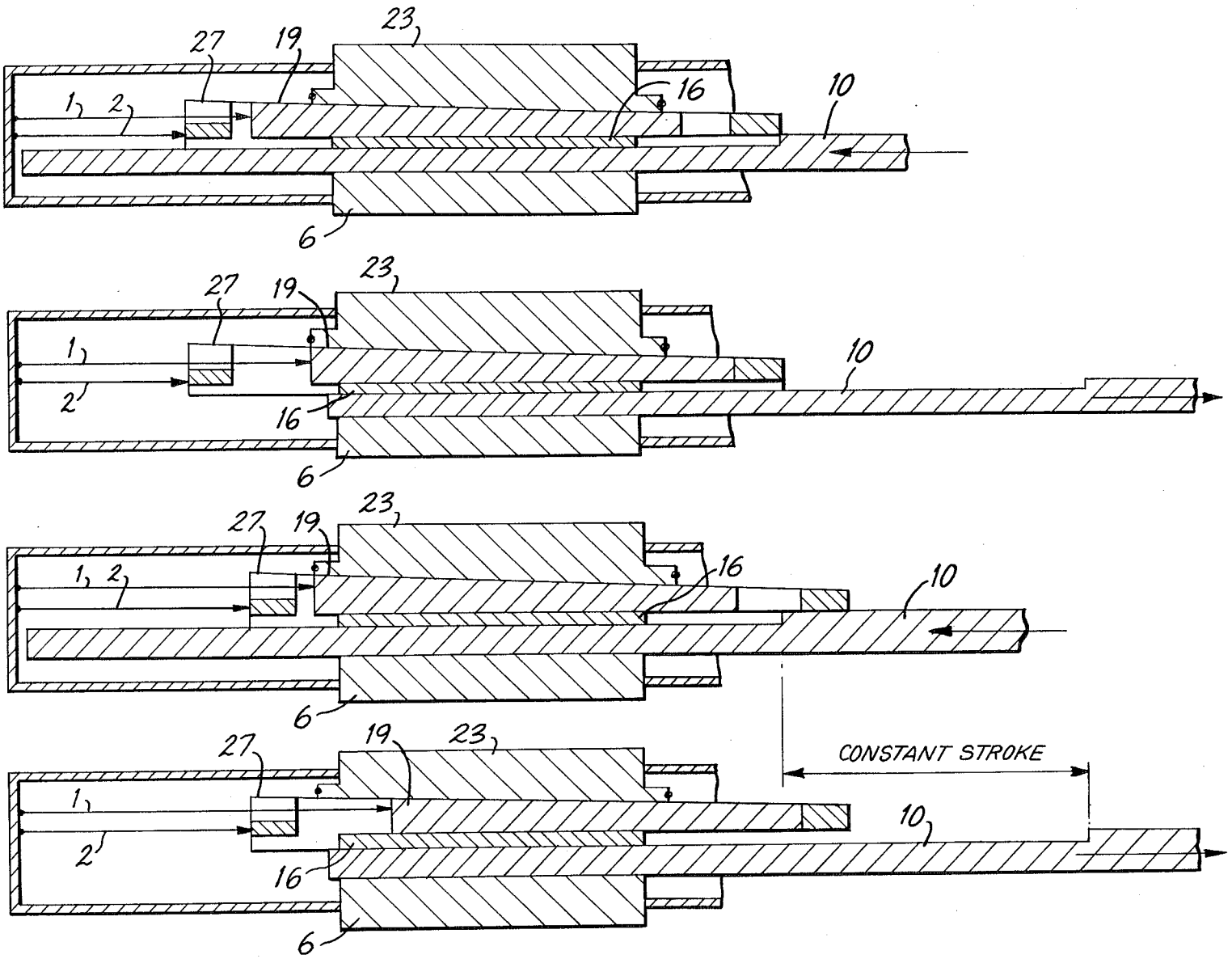

FIGS. 6A to 6F show in another manner how the spring 33 and 34 activate the creeping and holding actions of pressure wedge 19 and holding wedge 27. Arrows 1 and 2 indicate the entry progression of each of the wedges 19 and 27. Actually arrows 1 and 2 indicate springs 33 and 34 acting upon these wedges. FIG. 6A illustrates the start position while FIG. 6B illustrates the position of wedges 19 and 27 after the first power stroke of power wedge 10. Pressure wedge 19 has moved laterally as has cracker bar 23 and holding wedge 27 has moved longitudinally to fill any voids in the apparatus. FIG. 6C illustrates the withdrawl of power wedge 10 and the longitudinal movement of pressure wedge 19 to fill any voids now remaining. Holding wedge 27 has held its position. FIG. 6D illustrates the position of wedges 19 and 27 immediately following the next power stroke of power wedge 10. Pressure wedge 19 and cracker bar 23 have moved laterally and holding wedge 27 has been moved longitudinally to fill the void created by expansion of rock buster 2. FIG. 6E illustrates that when power wedge 10 is withdrawn after the power stroke of FIG. 6D holding wedge 27 holds its position and pressure wedge 19 is moved longitudinally to fill any voids in rock buster 2. FIG. 6F illustrates that on the next power stroke of power wedge 10, pressure wedge 19 and cracker bar 23 are moved laterally and holding wedge 27 moves longitudinally to fill the resulting void. FIG. 6G is a view that demonstrates that as holding wedge 27 is thrust forward longitudinally it reaches a point at which it is able to trigger reset mechanism 15 contained on surface 11 of power wedge 10.

The reset mechanism 15 is pushed by the transverse surface 30 of holding wedge 27 once holding wedge 27 enters the territory of the last stroke of the power wedge in its preset operating cycle. It is this action which ultimately causes the reset mechanism trigger to deploy the reset mechanism.

Figure 7:
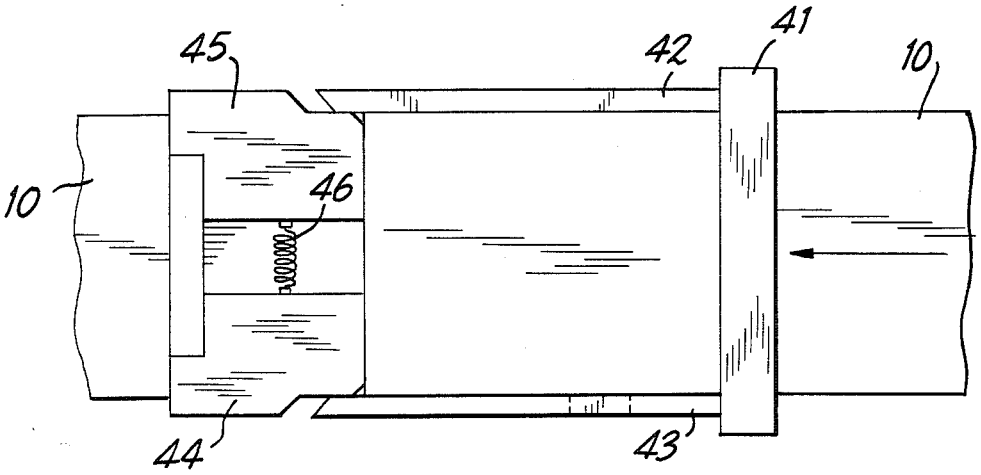
FIGS. 7–10 are top and side views of a reseting mechanism employed in the apparatus in accordance with the principles of the present invention.
Figure 8:
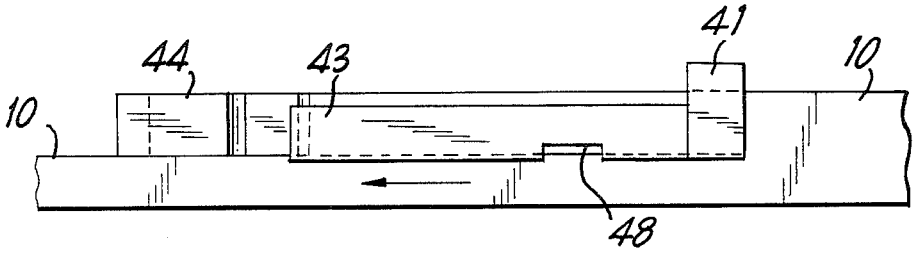
Figure 9:
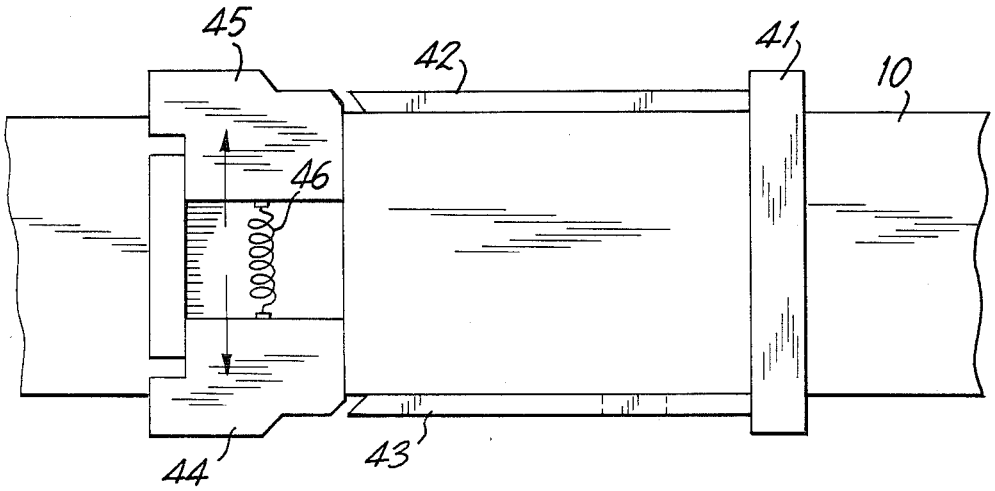
Figure 10:
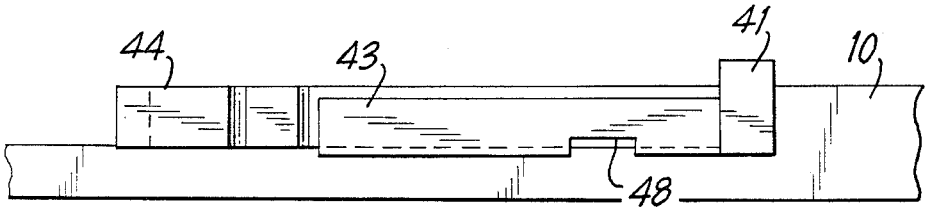
Figure 11A:
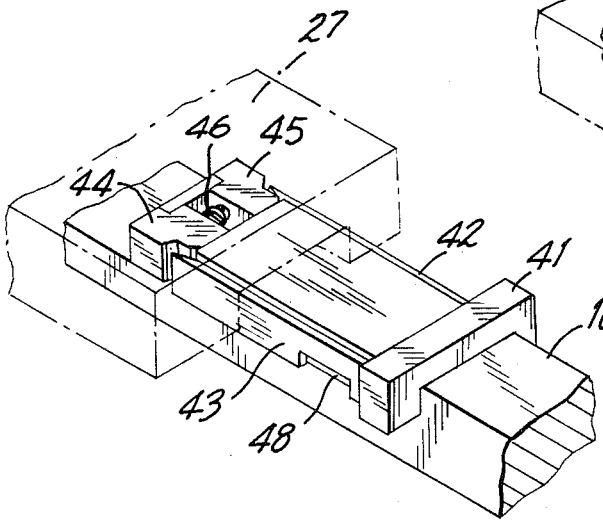
FIGS. 11A–11D illustrate the operation of the reset mechanism of FIGS. 7–10.
Figure 11B:
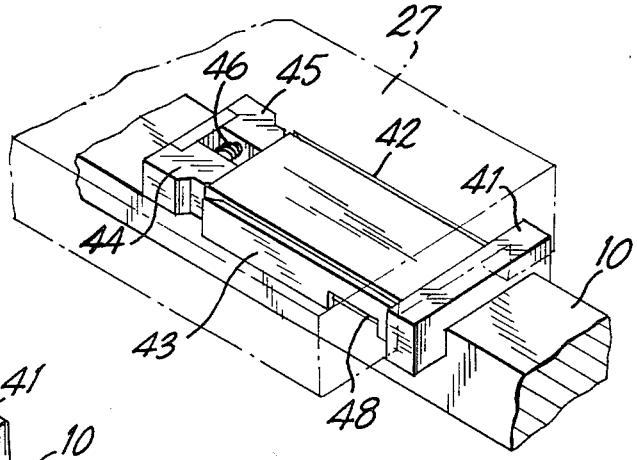
Figure 11C:
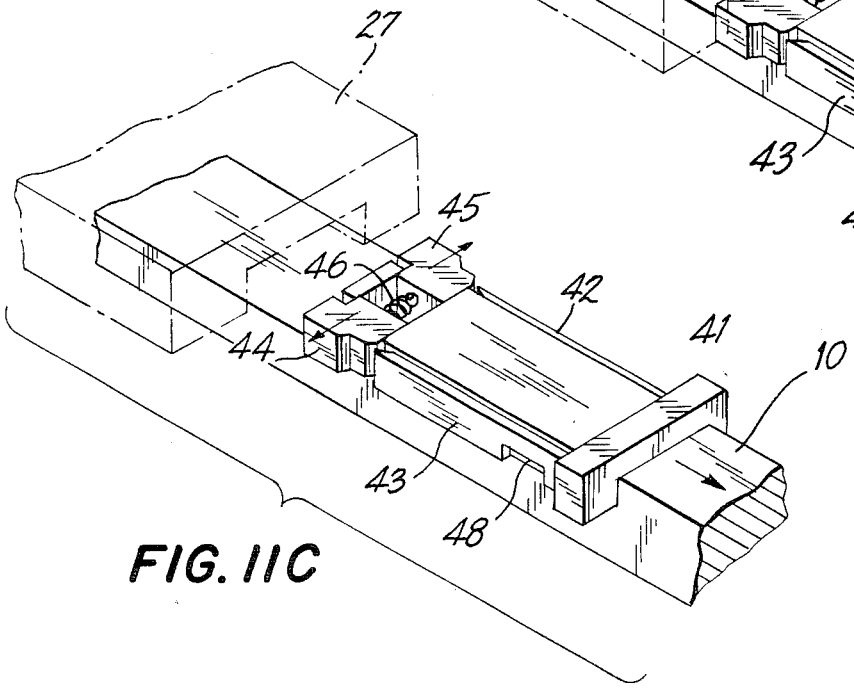
Figure 11D:
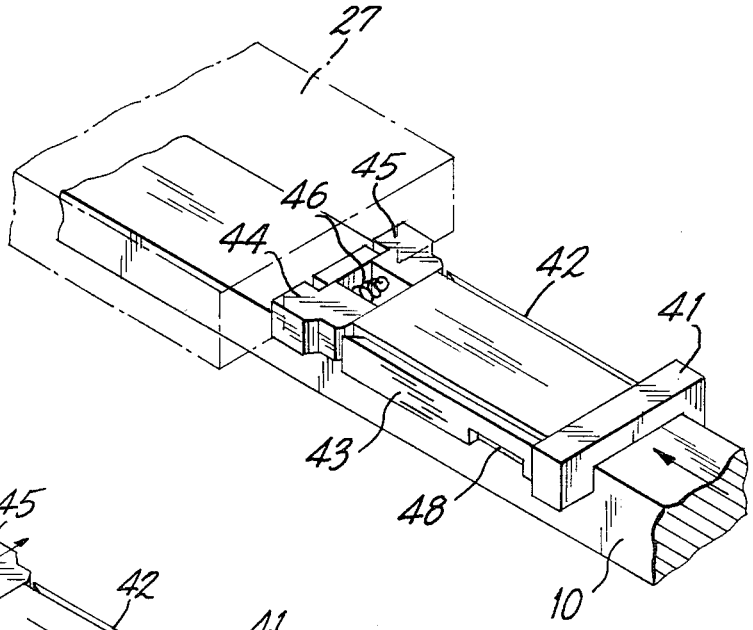
Figure 12:
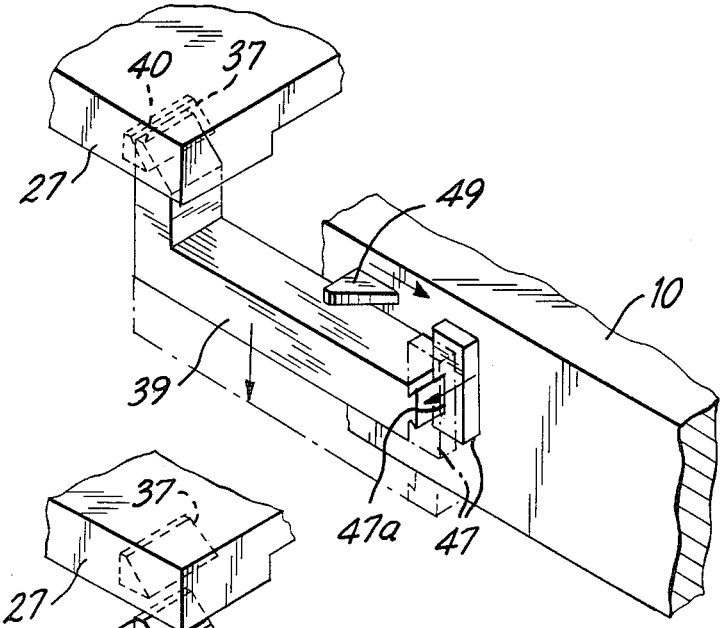
FIGS. 12 and 13 are prospective views of a locking mechamism employed in the apparatus in accordance with the principles of the present invention.

FIGS. 7–10 illustrate the components of reset mechanism 15. The reset trigger includes a member 41 disposed in a transverse relationship with surface 11 of power wedge 10 and two members 42 and 43 extending therefrom which in the undeployed or retracted position of the reset mechanism maintain a pair of members 44 and 45 which are spring loaded by a spring 46 in the undeployed or retracted position as shown in FIGS. 7, 8, and 11A. When member 41 comes in contact with transverse surface 30 of holding wedge 27 during the penultimate power stroke of the operating cycle, members 42 and 43 are pulled back so that members 44 and 45 are free to move outwardly under the action of spring 46. However, this can not occur since the members 44 and 45 are still within the holding wedge 27 as illustrated in FIG. 11B. Once power wedge 10 has been withdrawn after its penultimate stroke of the cycle of operation, members 44 and 45 will now deploy and move outwardly from each other as shown in FIG. 9, 10 and 11C so that the next and actually the last inward stroke of power piston 10 will cause the front surface of members 44 and 45 to abut transverse surface 30 of holding wedge 27 so that holding wedge 27 and the other wedges associated therewith are moved to place them in the start condition. This is shown in FIG. 11D.

The reset trigger is essentially a slide which is pulled back by the action of holding wedge 27 in the final phase of its inward strokes in an operating cycle. Its purpose is to allow the reset head to deploy. In its retracted position reset trigger keeps the spring loaded members 44 and 45 closed. The reset head must be closed during the power strokes to allow power wedge 10 to complete its full power stroke. That is, the reset mechanism must go within holding wedge 27 in opening 29 without hitting transverse surface 30 of holding wedge 27. Once rock buster 2 has completed its cycle of operation of cracking the rock and holding wedge 27 has progressed to the point at which the reset trigger is tripped, spring loaded members 44 and 45 will perform its function of pushing holding wedge 27, along with the pressure wedge 19, back to the start position. This is accomplished by making power wedge driven reset head, now in its expanded state, unable to enter holding wedge 27 and thereby pushing it back to its start position by the last stroke of power wedge 10. Referring to FIGS. 12–14C, locking mechanism 39 includes a body having tapered portion 40 which thrusts itself into groove 39 in holding wedge 27 as described hereinabove. Reset driver 47 is fastened to locking mechanism 39 by a dove tail **47*a* and is capable of moving back and forth on this dove tail 47*a*. Reset driver 47 is able to engage in slot 48 located in member 43 of reset mechanism 15**.

The locking of pressure wedge 19 and holding wedge 27 takes place when the tapered portion 40 of locking mechanism 39 thrusts itself by a spring loaded action upward into groove 37 formed into the bottom of holding wedge 27. Throughout the previous cycle portion 40 has been pressed against the smooth bottom surface of holding wedge 27. Tapered portion 40 is able to enter slot 27 only when holding wedge 27 has been pushed by a full inward movement made by the power wedge 10 on its last inward stroke of the operating cycle.

Figure 13:
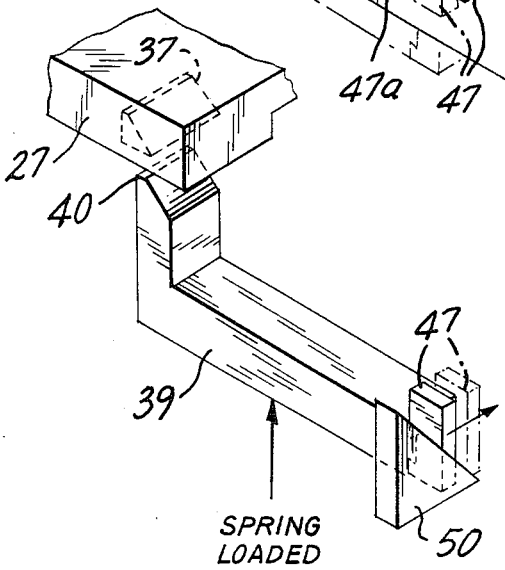

The locking mechanism action is begun in the position illustrated in FIG. 13. (Down with reset drive 47 in the drive position as shown in solid line in FIG. 13.) When the locking mechanism is thrust upward into slot 37 it not only locks pressure wedge 19 and holding wedge 27 but it also allows the reset driver 47 to enter and engage slot 48 in reset mechanism 15 back to its start position by means of driver 47 and slot 48. That is, members 42 and 43 are driven to again retract spring loaded members 44 and 45. Note FIG. 14A.

Figure 14A:
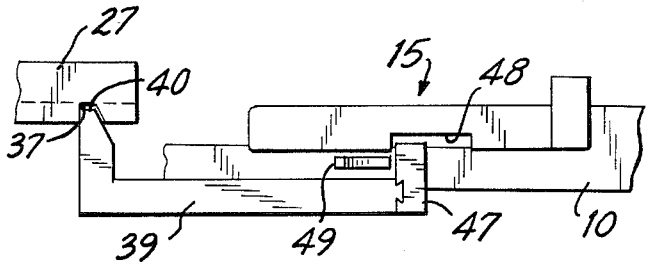
FIGS. 14A–14C are side views of the locking mechanism of FIGS. 12 and 13 illustrating the operation of this locking mechanism.
Figure 14B:
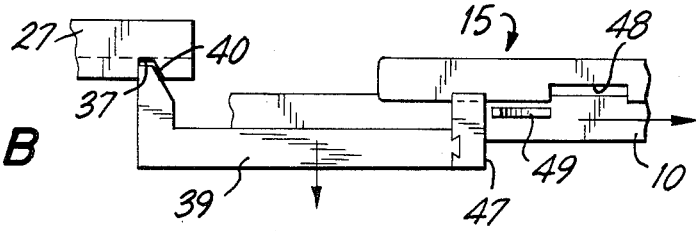

As power wedge 10 continues to withdraw cam 49 built into power wedge 10 disengages reset driver 47 from slot 48 by kicking it out as shown by the dotted line in FIG. 13 and also in FIG. 14B. Power wedge 10 is now able to continue its reciprocating motion without acting on rock buster 2 until the reciprocating motion is stopped by shutting down fluid actuated unit 3. This can happen because reset driver 47 has been kicked out of notch 48 by cam 49, reset mechanism 15 has been returned to the retracted position and the wedges 19 and 27 are no longer in a position to expand rock buster 2.

Figure 14C:
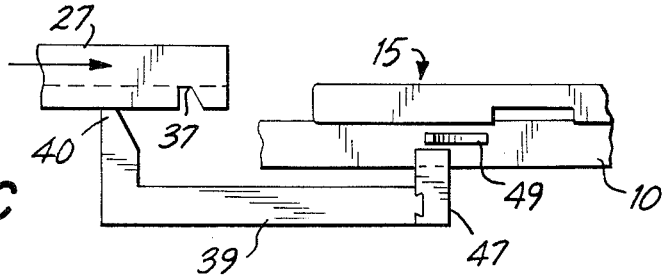

Reset driver 47 is in a "clear" position and unable to act upon rock buster 2 when it is in either one of two positions, namely, (1) kicked "out" by cam 49 with locking mechanism 39 in the up position; or (2) kicked "in"by cam 50 with locking mechanism 39 in the down position as shown in FIG. 14C. Reset driver 47 is in position to reset the trigger of reset mechanism 15 only after it has been kicked in by cam 50 and locking mechanism is in the up position.

To start a new cycle of operation locking mechanism 39 is released (by a manual switch mounted on the exterior of the housing out of harms way or by some automatic means) by causing locking mechanism 39 to be moved downward against its spring force until it is out of slot 37. Note FIG. 14C. This action causes rock buster 2 to expand in predrilled hole 1 by springs 33 and 34 acting upon holding wedge 27 and pressure wedge 19. These wedges are driven forward until rock buster 2 expands to the hole size. Note in FIG. 14C that the movement of holding wedge 27 has moved slot 37 away from tapered portion 40 of locking mechanism 39 so that for the remainder of the new cycle of operation tapered portion 40 can no longer reenter slot 37.

The movement of locking mechanism 39 downward also accomplishes another necessary function. This movement causes reset driver 47 to be returned to its kick in position (reset position or locking position) by cam 50 built into the housing at an appropriate location.

While I have described above the principles of my invention in connection with specific apparatus, it is to be clearly understood that this description is made only by way of example and not as a limitation to the scope of my invention as set forth in the objects thereof and in the accompanying claims.

I claim:

1. Apparatus to break rock and concrete slabs in situ when inserted into predrilled holes in said rock and concrete slabs comprising:

first and second members each having an outer surface engaging a wall of said predrilled holes and a longitudnal axis parallel to each other and said wall of said predrilled holes, said first member having a longitudnal groove therein, said groove including a flat bottom surface parallel to said longitudnal axes of said first and second members coextensive with said first member, a first pair of spaced vertical surfaces extending upward from and perpendicular to said bottom surface and coextensive therewith, a pair of spaced ledge-like surfaces disposed in a plane parallel to said bottom surface extending outward from said first pair of vertical surfaces and coextensive therewith, and a second pair of spaced vertical surfaces extending upward perpendicular to and from the outer edges of said pair of ledge-like surfaces and coextensive therewith;

a third member having a driven end, a free end, a first surface parallel to said longitunal axes of said first and second members slidably engaging said bottom surface and said first pair of vertical surfaces of said groove in said first member and a second surface opposite said first surface having a first predetermined slope along a given length from a point adjacent said driven end to said free end, said third member reciprocating in said groove a predetermined number of times greater than one during each cycle of operation and with a predetermined stroke length; and means, disposed between said second surface of said third member and an inner surface of said second member at least a portion of which slidably engages said pair of ledge-like surfaces and said second pair of vertical surfaces, activated by each inward stroke of said third member to apply a powerful breaking force directly to said second member resulting in lateral movement thereof, to apply a reaction force equal to said breaking force to said first member and to retain said second member in its achieved position due to said lateral movement thereof at the end of each inward stroke of said third member during said cycle of operation.

2. Apparatus according to claim 1, wherein the thickness of said third member decreases by a predetermined amount at said free end thereof to provide said first predetermined slope along said given length.

3. Apparatus according to claim 2, further including a housing to protect said first, second, and third members, and said means to apply and retain from dust, dirt and the like; and a lubricant disposed in said housing to lubricate engaging surfaces of said first, second and third members and members of said means to apply and retain.

4. Apparatus according to claim 3, wherein said portion of said means to apply and retain and said second member slidably engage said second pair of vertical surfaces.

5. Apparatus according to claim 4, further including reset means secured to said third member adjacent said driven end to reset said means to apply and retain to its starting position at the end of each of said cycles of operation.

6. Apparatus according to claim 5, wherein said reset means includes a pair of members disposed on said second surface of said third member adjacent said driven end, a spring disposed between said pair of members for spring loading thereof, retaining means disposed on said second surface of said third member adjacent said driven end to retain said spring loaded pair of members in a retracted position, said spring loaded pair of members and said retaining means entering said means to apply and retain on each stroke except the last stroke of said third member during each of said cycles of operation, and trigger means secured to said retaining means to release said retaining means by contact with a transverse surface of said means to apply and retain on the penultimate inward stroke of said third member during each of said cycles of operation, said spring loaded pair of members being deployed outward when said third member is withdrawn from said means to apply and retain prior to the last inward stroke thereof during each of cycles of operation, said deployed spring loaded pair of members engaging said transverse surface of said means to apply and retain for reseting thereof to its starting position by the last inward stroke of said third member during each of said cycles of operation.

7. Apparatus according to claim 6, wherein said reset means further includes a locking means associated with said retaining means and said means to apply and retain to hold said means to apply and retain in its starting position and to reset said retaining means, said locking means being operated to release said means to apply and retain to start each of said cycles of operation.

8. Apparatus according to claim 1, further including a housing to protect said first, second, and third members, and said means to apply and retain from dust, dirt and the like; and a lubricant disposed in said housing to lubricate engaging surfaces of said first, second and third members and members of said means to apply and retain.

9. Apparatus according to claim 1, wherein said portion of said means to apply and retain and said second member slidably engage said second pair of vertical surfaces.

10. Apparatus according to claim 1, further including reset means secured to said third member adjacent said driven end to set said means to apply and retain to its starting position at the end of each of said cycles of operation.

11. Apparatus according to claim 1, wherein said reset means includes a pair of members disposed on said second surface of said third member adjacent said driven end, a spring disposed between said pair of members for spring loading thereof, retaining means disposed on said second surface of said third member adjacent said driven end to retain said pair of members in a retracted position, said spring loaded pair of members and said retaining means entering said means to apply and retain on each stroke except the last of said third member during each of said cycles of operation, and trigger means secured to said retaining means to release said retaining means by contact with a transverse surface of said means to apply and retain on the penultimate inward stroke of said third member during each of said cycles of operation, said spring loaded pair of members being deployed outward when said third member is withdrawn from said means to apply and retain prior to the last inward stroke thereof during each of said cycles of operation, said deployed spring loaded pair of members engaging said transverse surface of said means to apply and retain for reseting thereof to its starting position by the last inward stroke of said third member during each of said cycles of operation.

12. Apparatus according to claim 11, wherein said reset means further includes a locking means associated with said retaining means and said means to apply and retain to hold said means to apply and retain in its starting position and to reset said retaining means, said locking means being operated to release said means to apply and retain to start each of said cycles of operation.

13. Apparatus according to claim 1, wherein said means to apply and retain includes a fourth member having a first surface parallel to said longitudnal axes of said first and second members and a second surface opposite said first surface slidably engaging said second surface of said third member, said second surface of said fourth member having a slope equal to but opposite said first predetermined slope;

a fifth member having a first surface parallel to said longitudnal axes of said first and second members slidably engaging said first surface of said fourth member and a second surface opposite said first surface having a second predetermined slope engaging said inner surface of said second member, said inner surface of said second member having a slope equal to but opposite said second predetermined slope, said fifth member responding to each inward stroke of said third member through said fourth member to apply said powerful breaking force to said second member and said reaction force to said first member, said second member moving laterally outward a greater amount on each inward stroke of said third member; and a sixth member straddling said third and and fourth members and enclosing said fifth member, said sixth member having a first surface slidably engaging said pair of ledge-like surfaces parallel to said longitudnal axes of said first and second members and a second surface opposite said first surface having a slope equal to said second predetermined slope slidably engaging said inner surface of said second member to retain an outward position achieved by said second member after each inward stroke of said third member while said third member is withdrawn prior to its next inward stroke.

14. Apparatus according to claim 13, wherein said fifth and sixth members are spring loaded longitudinally.

15. Apparatus according to claim 14, wherein said second surfaces of said fifth and sixth members include therein low profile teeth slidably engaging low profile teeth present in said inner surface of said second member, said low profile teeth in said second surface of said sixth member and said inner surface of said second member cooperating to maintain said outward position achieved by said second member after each inward stroke of said third member.

16. Apparatus according to claim 15, wherein the thickness of said third member decreases by a predetermined amount at said free end thereof to provide said first predetermined slope along said given length.

17. Apparatus according to claim 15, further including a housing to protect said first, second, third, fourth, fifth, and sixth members from dust, dirt and the like; and a lubricant disposed in said housing to lubricate engaging surfaces of said first, second, third, fourth, fifth and sixth members.

18. Apparatus according to claim 15, wherein said second and sixth members slidably engage said second pair of vertical surfaces and said fourth member slidably engages said first pair of vertical surfaces.

19. Apparatus according to claim 15, further including reset means secured to said third member adjacent said driven end to reset said fourth, fifth and sixth members to their starting positions at the end of each of said cycles of operation, said reset means including a pair of members disposed on said second surface of said third member adjacent said driven end, a spring disposed between said pair of members for spring loading thereof, retaining means disposed on said second surface of said third member adjacent said driven end to retain said spring loaded pair of members in a retracted position, said spring loaded pair of members and said retaining means entering said sixth member on each stroke except the last of said third member during each of said cycles of operation, and trigger means secured to said retaining means to release said retaining means by contact with a transverse surface of said sixth member on the penultimate inward stroke of said third member during each of said cycles of operation, said spring loaded pair of members being deployed outward when said third member is withdrawn from said sixth member prior to the last inward stroke thereof during each of said cycles of operation, said deployed spring loaded pair of members engaging said transverse surface of said sixth member for reseting said fourth, fifth and sixth members to their starting position by the last inward stroke of said third member during each of said cycles of operation.

20. Apparatus according to claim 19, wherein said reset means further includes a locking means associated with said retaining means and said sixth member to hold said fourth, fifth and sixth members in their starting position and to reset said retaining means, said locking means being operated to release said sixth member and, hence, said said fourth and fifth members to start each of said cycles of operation.

* * * * *